US012624925B1

(12) United States Patent
Major

(10) Patent No.: US 12,624,925 B1
(45) Date of Patent: May 12, 2026

(54) HINGED SCOPE RING

(71) Applicant: Berry Mtn., Inc., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 18/375,032

(22) Filed: Sep. 29, 2023

Related U.S. Application Data

(63) Continuation-in-part of application No. 17/577,072, filed on Jan. 17, 2022, now Pat. No. 11,971,242.

(60) Provisional application No. 63/138,184, filed on Jan. 15, 2021.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 2,125,932 A * 8/1938 Lennon ..... F41G 11/001 89/200
2,447,892 A * 8/1948 Baliff ..... F41G 11/004 362/396
2,449,551 A * 9/1948 Garand ..... F41G 11/001 42/124
2,601,613 A * 6/1952 Jahncke ..... F41G 1/34 248/295.11
2,663,083 A * 12/1953 Harms ..... F41G 11/001 42/126
2,717,447 A * 9/1955 Leupold ..... F41G 11/001 24/514
2,782,511 A * 2/1957 Ivy ..... G02B 23/00 42/126
2,803,880 A * 8/1957 Weaver ..... F41G 11/002 16/221
3,253,361 A * 5/1966 Kingsbury ..... F41G 11/003 D16/132
3,295,811 A * 1/1967 Giwosky ..... F41G 11/003 248/229.11
3,401,460 A * 9/1968 Tellie ..... G02B 27/646 42/124
3,463,430 A * 8/1969 Jimenez ..... F41G 11/003 248/229.15
3,491,975 A * 1/1970 Weaver ..... F41G 11/001 42/124

(Continued)

*Primary Examiner* — Michelle Clement
(74) *Attorney, Agent, or Firm* — Hooker & Habib, P.C.

(57) ABSTRACT

A scope ring for attaching a rifle scope to a mounting rail of an armament includes a lower component that is attached onto the mounting rail and an upper component that is fastened to the lower component to define and extend along an outer perimeter of a scope ring through-hole that receives and holds the scope. The upper component member extends at least one hundred eighty (180) degrees along the perimeter but is constructed to enable a scope to be received into the scope ring or be removed from the scope ring if the scope ring extends more than one hundred eighty (180) degrees to present a slimmer profile. The upper component can be attached to different compatible lower components that enable the scope ring to define different scope ring heights.

13 Claims, 8 Drawing Sheets

(56) References Cited

U.S. PATENT DOCUMENTS

| | | | | | |
|---|---|---|---|---|---|
| 4,574,508 | A * | 3/1986 | Ross | F41G 11/003 | D22/109 |
| 5,155,915 | A * | 10/1992 | Repa | F41G 1/383 | 42/129 |
| 5,490,654 | A * | 2/1996 | Herriman | F41G 11/001 | 248/316.1 |
| 6,315,256 | B1 * | 11/2001 | Tolar | F41A 23/00 | 248/316.1 |
| 6,705,037 | B2 * | 3/2004 | Van Kirk | F41G 11/002 | 42/126 |
| 7,562,484 | B2 * | 7/2009 | Kim | F41G 11/004 | 24/282 |
| 8,171,666 | B2 * | 5/2012 | Karagias | F41G 11/003 | 42/127 |
| 8,572,885 | B2 * | 11/2013 | Karagias | F41G 11/003 | 42/124 |
| 8,707,610 | B2 * | 4/2014 | Troy | F41G 11/003 | 42/124 |
| 9,212,777 | B2 * | 12/2015 | Shi | F41G 11/004 | |
| 9,243,870 | B2 * | 1/2016 | Teetzel | G02B 23/125 | |
| 11,092,437 | B1 * | 8/2021 | McCoy, II | F41G 1/54 | |
| 11,306,999 | B2 * | 4/2022 | Ma | F41G 1/387 | |
| 11,365,968 | B2 * | 6/2022 | McCoy, II | G01C 9/28 | |
| 11,971,242 | B1 * | 4/2024 | Major | F41G 1/387 | |
| 2011/0023348 | A1 * | 2/2011 | Karagias | F41G 11/003 | 42/124 |
| 2012/0291331 | A1 * | 11/2012 | Troy | F41G 11/003 | 42/124 |

* cited by examiner

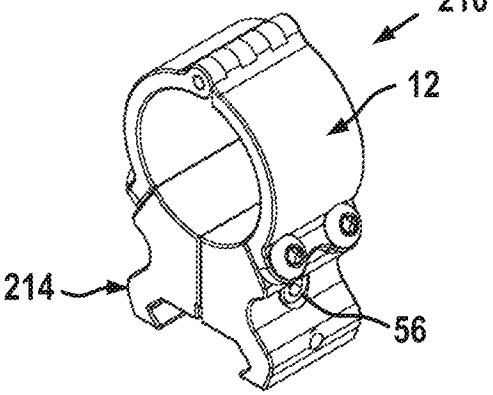
FIG. 9
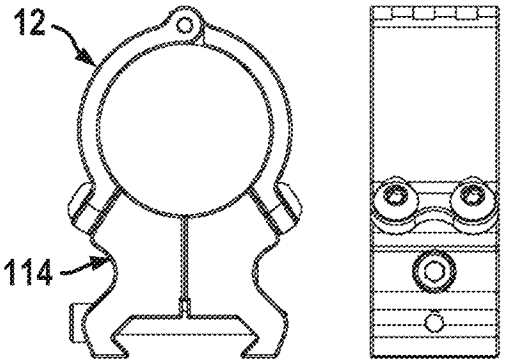
FIG. 10
FIG. 11
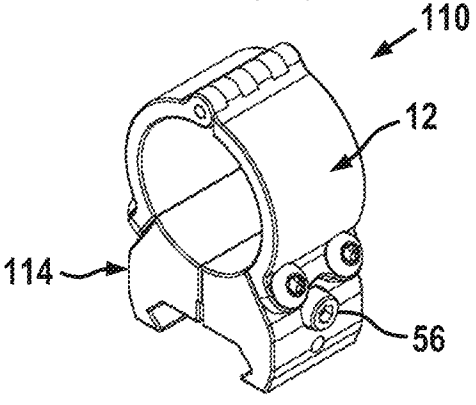
FIG. 6
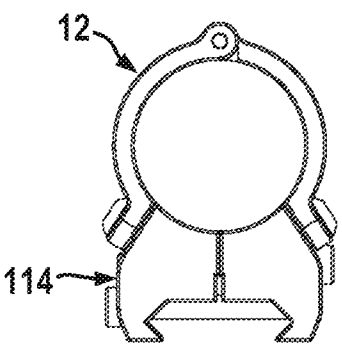
FIG. 7
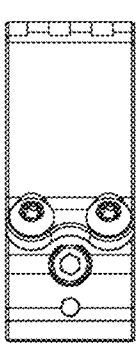
FIG. 8
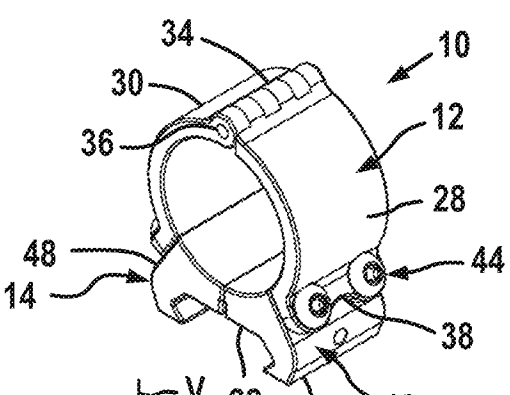
FIG. 1
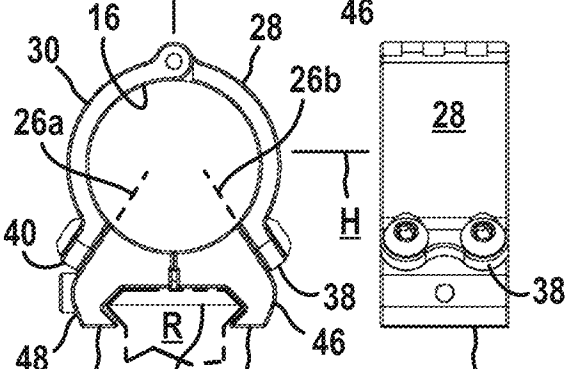
FIG. 2
FIG. 3

HINGED SCOPE RING

RELATED APPLICATION

This application is a continuation-in-part of and claims priority to and the benefit of the filing date of U.S. patent application Ser. No. 17/577,072 filed Jan. 17, 2022 and titled "Universal Scope Rings", which priority non-provisional patent application in turn claims priority to U.S. Patent Application No. 63/138,184 filed Jan. 15, 2021 and titled "Universal Scope Rings", each of the said priority applications incorporated by reference as if fully set forth herein.

FIELD OF THE DISCLOSURE

The disclosure relates generally to accessories for long guns, and in particular, to scope rings.

BACKGROUND OF THE DISCLOSURE

Long guns such as rifles often include a mounting rail that mounts accessories onto the gun. The two most common and well-known mounting rails are the Picatinny rail (standardized by the US military as MIL-STD-1913) and the Weaver rail. A Picatinny rail has an elongate body defining an elongate hexagonal rail and a spacer that spaces the rail above the gun. The rail has a number of spaced-apart cross slots and flats that allow accessories to be attached to the rail. A Weaver rail is similar to a Picatinny rail but the slot shape and spacing is somewhat different. Generally speaking, an accessory that can be attached to a Weaver rail can be attached to a Picatinny rail, but the reverse is not always true.

A common accessory for a long gun is a rifle scope, a telescope used to provide a more accurate aim. A rifle scope can be mounted to the rail using a pair of scope rings that are attached to the rail and are spaced apart along the rail.

FIG. 22 illustrates a scope ring 1010, a VORTEX® scope ring manufactured by Sheltered Wings, Inc. dba Vortex Optics, Barneveld, Wisconsin. The scope ring includes a body 1012 and a base 1014. The body defines an interior circular scope through-hole 1016 configured to securely receive and hold a cylindrical body tube of the rifle scope (not shown). The base mounts the body to the rail. The base includes a pair of opposed arms 1018 extending away from a lower flat portion 1020 of the body. The arms receive the rail between them with the body flat against the top of the rail.

The scope ring 1010 is formed as a multi-component member to enable the scope ring to receive the rifle scope body and to secure the scope ring to the rail. The body 1010 includes an upper body portion 1022 removably secured to a lower body portion 1024 by pairs of screws disposed on opposite lateral sides of the scope ring. One of the arms 1018 is removably attached to the lower body portion by screws.

The upper body portion 1022 and the lower body portion 1024 must have sufficient width to receive the pairs of screws. As a result, the scope ring 1010 when mounted on the rail has a relatively wide profile having a maximum width transverse to the rail extending a relatively large distance beyond both sides of the rail.

Rifle scope bodies conventionally have an outer diameter of either one inch or thirty millimeters. Scope rings come with either a one-inch scope through-hole sized to closely receive the one-inch scope body or a thirty-millimeter scope through-hole sized to closely receive the thirty millimeter scope body.

The scope rings must mount the rifle scope a sufficient height above the rail for clearance of the bell (the portion of the rifle scope holding the objective lens). Scope rings that directly attach onto the rail of the mounting rail come in standard scope ring heights as measured vertically from the body flat to the center of the scope through-hole. Standardized scope ring heights may vary by manufacturer; an example of a standard set of scope ring heights (low, medium, high, and extra-high) that will be referred to in illustrative embodiments of the disclosed scope ring and scope ring system is:

low: 1 inch
medium: 1.1 inches
high: 1.3 inches
extra-high: 1.4 inches

A scope ring defining a scope mounting height or scope height as referred to herein refers to the vertical distance from the center of the scope through-hole (essentially coaxial with the scope optical axis) to the top of the mounting rail. An auxiliary rail may also be interposed between the scope ring and the mounting rail to further increase scope mounting height.

Thus there is a need for a slimmer profile scope ring that can also mount a scope at selectively different scope heights without the need to replace the entire scope ring.

SUMMARY OF THE DISCLOSURE

Disclosed is a scope ring that has a slimmer profile but that can also mount a scope at selectively different scope ring heights without the need to replace the entire scope ring.

Embodiments of the disclosed scope ring include a lower component that attaches the scope ring to a mounting rail of an armament and an upper component fastenable to the lower component. The upper and lower components define a scope ring through-hole and extend along an outer perimeter of the scope ring through-hole to holds and secures a scope held in the scope ring through-hole.

The upper component in embodiments extends more than 180 degrees along the outer perimeter of the scope ring through-hole to provide a slimmer profile. The upper component is hinged to enable a scope to be inserted into the scope ring or removed from the scope ring. The upper component can be completely removed from the lower component when inserting or removing the scope, or in variant embodiments, an end of the upper component can remain fastened to the lower component when inserting or removing the scope.

These embodiments of the scope ring enable a scope ring in which the upper component may be attached to different compatible lower components that, when attached to the upper component, define scope ring heights that are different for each lower component.

In other embodiments of the disclosed scope ring, a first end of the upper component is fastened to the lower component by a first hinge defining a pivot axis. The upper component extends at least one hundred eighty (180) degrees along the outer perimeter of the scope through-hole to a second end releasably fastened to the lower component. The second end is unfastened from the lower component when inserting a scope into the scope ring or removing a scope from the scope ring.

The first hinge connecting the lower component and upper component provides for a slimmer profile. If the upper member extends substantially more than one hundred eighty (180) degrees along the outer perimeter of the scope through-hole, an even slimmer profile can be provided.

The upper member in variant embodiments can include two or more members extending end-to-end from the first end to the second end of the upper member. Adjacent pairs of members are connected by an additional hinge that enables pivotal displacement of the members relative to one another to enable inserting a scope into the scope ring or removing a scope from the scope ring.

The first hinge can be removably fastened to the lower component. This enables a scope ring in which the hinge and the upper component to be attached to different compatible lower components that, when attached to the upper component via the hinge, define scope ring heights that are different for each lower component.

Other objects and features of the disclosure will become apparent as the description proceeds, especially when taken in conjunction with the accompanying drawing sheets illustrating one or more illustrative non-limiting embodiments.

BRIEF DESCRIPTION OF THE DRAWINGS

FIGS. 1-3 are perspective, front, and side views respectively of a first embodiment scope ring in accordance with this disclosure.

FIGS. 6-8 are perspective, front, and side views respectively of a second embodiment scope ring in accordance with this disclosure.

FIGS. 9-11 are perspective, front, and side views respectively of a third embodiment scope ring in accordance with this disclosure.

DETAILED DESCRIPTION

Figure 4:
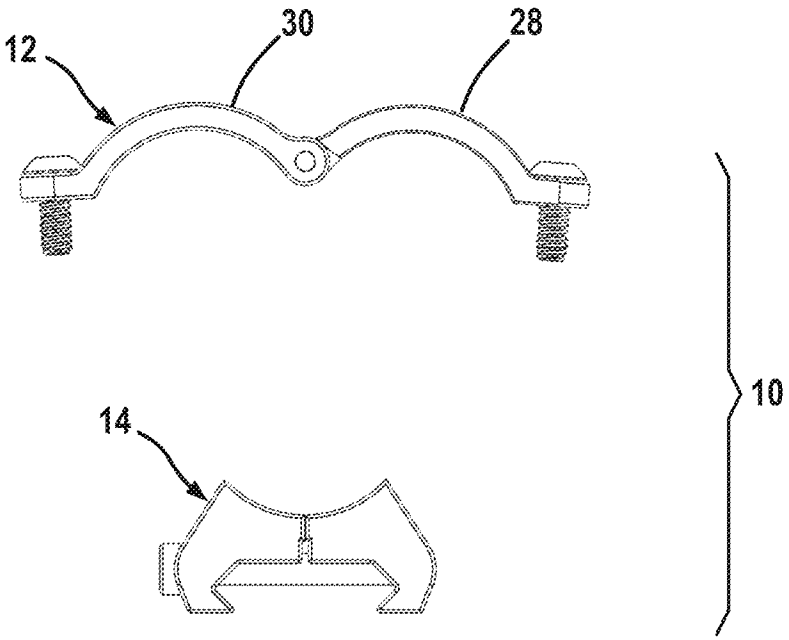
FIG. 4 is a front, partially exploded view of the scope ring shown in FIG. 1.

FIGS. 1-3 illustrate an assembled scope ring 10 in accordance with this disclosure. The illustrated scope ring 10 is configured to be mounted directly onto a Picatinny mounting rail R. The scope ring 10 defines a low scope ring height when mounted directly on the mounting rail R.

The scope ring 10 includes a first member or upper component member 12 and a second member, or lower component member 14 that cooperatively define a generally circular scope through-hole 16. The scope through-hole 16 is configured to receive, surround, and hold a cylindrical body tube of a rifle scope (not shown). The curved interior surface portions of the upper and lower component members 12, 14 that surround and define the through-hole 16 are designed to engage and secure a standard one-inch diameter or standard thirty-millimeter scope ring body tube in the scope ring.

Other embodiments of the scope ring 10 can be designed to secure non-standard diameter rifle scope body tubes or other auxiliary devices such as laser tubes, night vision optics, or the like having other diameters.

The mounting rail R extends along a central longitudinal axis that defines a central, vertical plane of symmetry V of the rail. The plane V extends through the longitudinal axis and through the center of the through-hole 16 of the scope ring mounted onto the rail. The plane V and the scope ring 10 further cooperate to define a horizontal plane H transverse to the plane V that extends through the center of the through-hole 16 when the scope ring 10 is mounted onto the rail R.

The lower component member 14 is configured to mount the scope ring 10 to a mounting rail. The illustrated lower component member 14 defines a base 18 on a lower end portion of the lower component member that mounts the scope ring 10 to a Picatinny mounting rail R. Other embodiments of the base 18 can be configured to mount the scope ring 10 onto other types of mounting rails.

To secure the scope ring 10 onto a Picatinny rail, the base 18 includes a pair of base arms 20*a*, 20*b* extending away from a flat surface 22 of the base 18. The base arms receive the Picatinny rail between them. The arms 20*a*, 20*b* cooperate with the flat surface 22 to define a slot that closely conforms with the exterior geometry of the Picatinny rail. The surface 22 and arms 20*a*, 20*b* secure the scope ring 10 onto the mounting rail R when received into the slot.

The upper component member 12 and the lower component member 14 are removably fastened to one another along facing pairs of flat surfaces that meet along parting planes 26*a*, 26*b* located on opposite sides of the scope through-hole 16. The parting planes 26*a*, 26*b* extend radially with respect to the scope ring through-hole 16 and are inclined at an angle of about 60 degrees from the horizontal plane H.

As viewed in FIG. 2, when attached to the lower component member 14 the illustrated upper component member 12 extends counterclockwise about 270 degrees in angular extent around the scope through-hole 12 from the parting plate 26*b* to the parting plane 26*a*. The illustrated lower component member 12 extends about 90 degrees in angular extent in the same direction from the parting plane 26*a* back to the parting plane 26*b*.

The upper component member 12 is a multi-component member that includes a right upper component member 28 and a left upper component member 30. See also FIG. 4, which shows the upper component member 12 removed from the lower component member 14.

The right upper component member 28 and the left upper component member 30 are each essentially a curved member having an inner radius defining the radius of the through-hole 16. The left and right upper component member 28, 30 each extend in angular extent about 150 degrees.

The upper ends of the left and right upper component members 28, 30 cooperatively define a pivotal hinge 34 that pivotally couple the left and right upper component members 28, 30. The hinge 34 receives a hinge pin 36 that defines the pivot axis of the hinge joint. The hinge pin 36 extends parallel with the longitudinal axis of the mounting rail when the scope ring 10 is attached onto the rail. The ends of the hinge pin 36 can be enlarged to resist the pin falling out of the hinge.

An outwardly extending flange 38 extends from the free end of the right upper component member 28 and a corresponding outwardly extending flange 40 extends from the free end of the left upper component member 30. Each flange 38, 40 has a flat lower surface that engages against a corresponding flat surface of the lower base member 14 along the parting plane 26*a* the parting plane 26*b*. Screws 44 extend through holes in the flanges 38, 40 and extend into threaded holes in the lower base member 14.

The screws removably fasten the upper component member 12 with the lower component member 14. While the upper component member 12 is fastened to the lower component member 14, the upper component member 12 defines an essentially rigid member that can cooperate with the lower component member 14 in securely holding a rifle scope in the scope holder 10.

The flanges 38, 40 are inclined with respect to the horizontal plane V as illustrated in FIG. 1 when the upper mounting component 12 is attached to the lower mounting component 14. The flanges begin extending away from the left and right upper component members while the flanges are inward of the maximum horizontal width of the upper component member cut by the horizontal plane H. The flanges 38, 40 and the screws 44 extend outwardly in the horizontal direction away from the maximum horizontal width of the upper component member 12 only a relatively short distance to form a more compact attachment structure as seen in FIG. 2 as compared to a conventional construction in which each of the upper and lower component members 12, 14 extend 180 degrees around the scope ring through-hole 16 and the parting planes 26*a*, 26*b* are horizontal as in the attachment structure shown in FIG. 15.

The right and left upper component members 28, 30 are pivotable with respect to one another about the hinge pin 36 when one or both of the upper component members 28, 30 are not attached to the lower component member 14. If the upper component member 12 were a rigid structure, the body tube of the rifle scope could not be received into the upper component member because its angular extent is greater than 180 degrees. It is preferred, but not necessary, that the angular extent of the upper component member 14 extend at least 240 degrees about the scope ring through-hole 16 to provide a compact attachment structure and slim profile.

Because of the hinged construction of the upper component member 12, the right and left upper component members 28, 30 can pivot relative to each other when removed from the lower component member 12. See FIG. 4, which illustrates the right and left upper component members 28, 30 pivotally displaced with respect to one another from their normal "working" positions as shown in FIG. 2 when fastened to the lower component member 14. The upper component member 12 can either open up to move away from the rifle scope body tube when removing the rifle scope body tube from the scope ring 10 or can close to partially surround the rifle scope body tube when mounting the rifle scope body tube into the scope ring 10.

The lower component member 14 is also a multi-component member that enables mounting the lower component member onto the mounting rail R. The lower component member 14 includes a right lower component member 46 and a left lower component member 48 separable along the vertical plane V when viewed as shown in FIG. 3. The right lower component member 46 includes the arm 20*a*. The left lower component member 48 includes the arm 20*b*. The right lower and left lower component members 46, 48*h* have facing flat outer surfaces that abut each other to form the lower component member 12. The surfaces are pressed against each other by a screw 50 generating a horizontal clamping force. The screw 50 extends through a hole in the left lower component member 46 and is threaded into a threaded hole in the right lower component member 48. The screw 50 extends through a transverse slot of the rail R when the lower base member 14 is attached onto the rail. The clamping force causes the lower component member 14 to be an essentially rigid member attached to the mounting rail that can cooperate with the upper component member 12 in securely holding a rifle scope in the scope holder 10.

To remove the scope ring 10 or the lower base member 14 from the rail, the upper component member 12 is removed from the lower component member 14. The screw 50 is then removed, enabling the left and right lower component members 46, 38 to separate and be removed from the rail.

Figure 5:
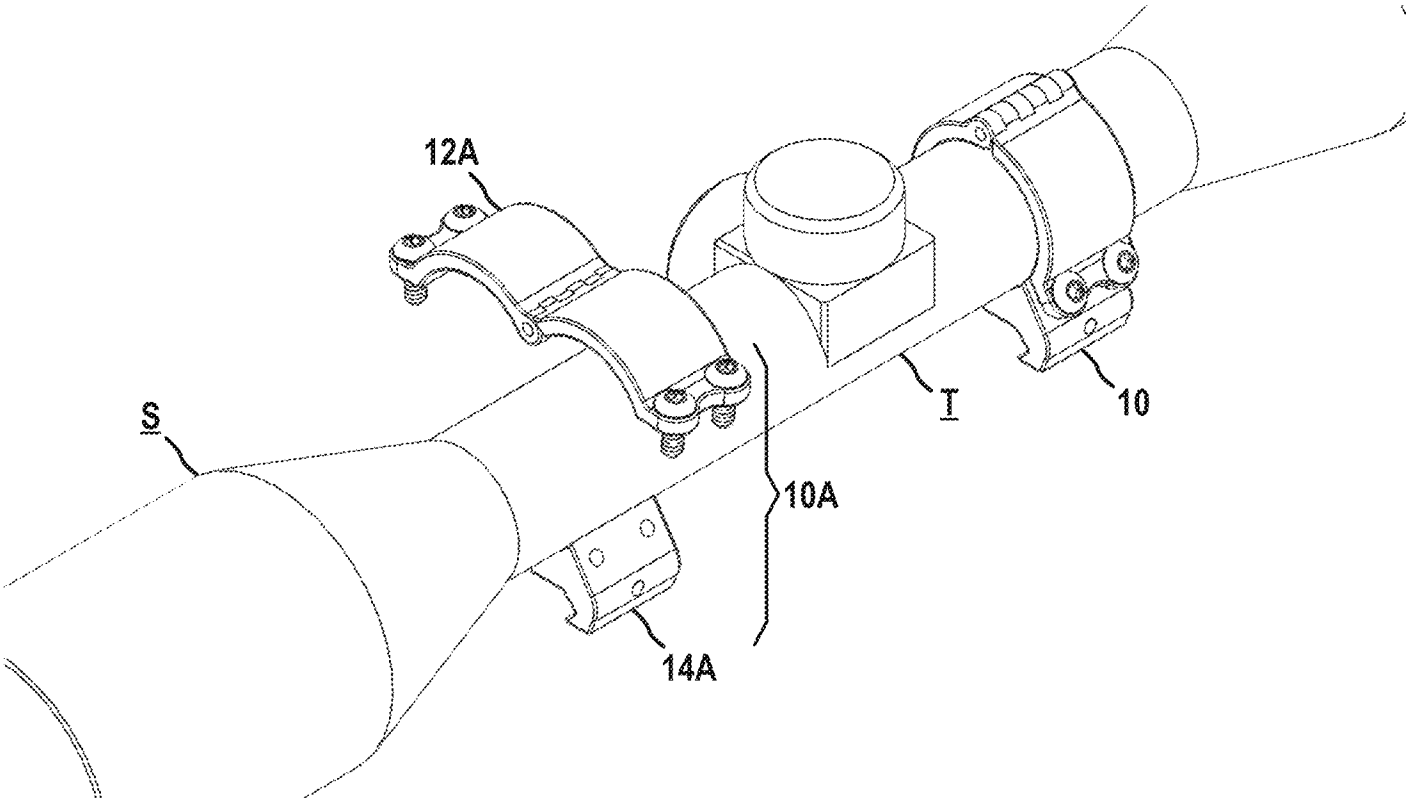
FIG. 5 is a partial view of a rifle scope being held and supported by the scope rings shown in FIG. 1.

FIG. 5 illustrates a portion of a rifle scope S having a forward end of the scope body tube T being held in a forward scope ring 10 and the back end of the body tube T being supported on the lower base member 14A of a back scope ring 10A. The forward and back scope rings 10, 10A are identical. The lower base member 14 of the scope ring 10 and the lower base member 14A are both mounted upon a Picatinny mounting rail (not shown) attached to a rifle (not shown).

The upper base member 12A of the scope ring 10A is shown separated from the lower base member 14A. The upper base member 12A is shown above the body tube T and vertically aligned with the lower base member 14A. This is a state of the scope ring 10A that can be arrived at when attaching the rifle scope S to the scope rings 10, 10A or removing the rifle scope S from the scope rings 10, 10A.

The scope ring 10 defines a low scope ring height when mounted directly on the mounting rail R. The scope ring height is determined by the distance the lower base member 14 distances or spaces the scope ring through-hole 16 away from the mounting rail.

FIGS. 6-8 illustrate a second embodiment scope ring 110 and FIGS. 9-11 illustrate a third embodiment scope ring 210. The second and third embodiment scope rings 110, 210 are each similar to the scope ring 10, but with the lower component members defining respectively different scope ring heights. All three embodiments utilize an identical upper component member 12 that is removably fastened to the lower component member by the screws 44.

The second embodiment scope ring 110 includes a lower component member 114 that is functionally similar to the lower component member 14. The scope ring 110 defines a medium scope ring height when mounted directly on the mounting rail R. The third embodiment scope ring 210 includes a lower component member 214 that is similar to the lower component member 14 but modified with concave indentations that lower the weight of the assembled scope ring. The scope ring 210 defines a high scope ring height.

Because of the greater distance between the base and the upper end of the lower component members 114, 214, the lower component members 114, 214 each include an additional screw 56 that fasten together the right and left lower component members. The additional screw 56 is spaced above the screw 50 and away from the arms. The screw 56 is spaced above the mounting rail when the lower base member is mounted onto the mounting rail. The screw 56 passes through a hole in one of the left and right lower base members and threads into a threaded hole in the other of the left and right lower base members. The screw 56 generates additional horizontal clamping force urging the right and left lower component members together to form a rigid lower component member.

A scope ring can be provided with an upper component member 12 along with a lower component member 14, a lower component member 114, a lower component member 214, and/or a lower component member that defines an extra high scope ring height. The user can select which lower component member to attach to the mounting rail to achieve the desired scope ring height.

Figure 14:
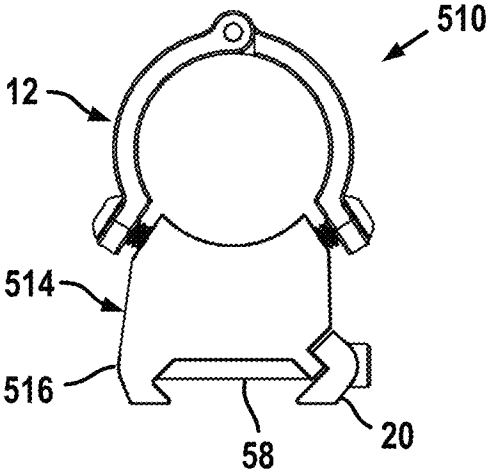
FIGS. 12, 13, and 14 are front views respectively of a fourth embodiment, fifth embodiment, and sixth embodiment scope ring in accordance with this disclosure.
Figure 13:
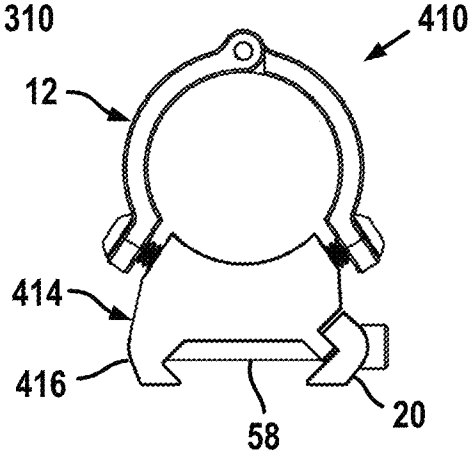
Figure 12:
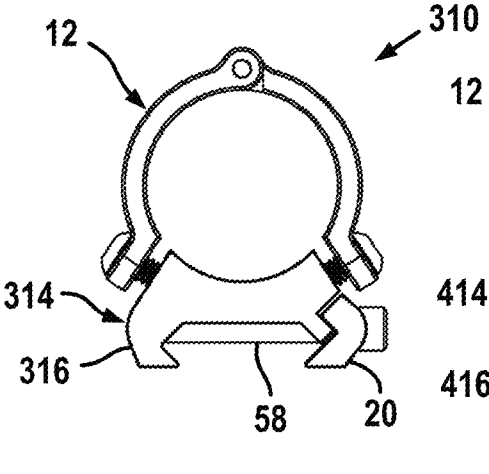

FIGS. 12-14 illustrate respectively a fourth embodiment scope ring 310, a fifth embodiment scope ring 410, and a sixth embodiment scope ring 510. Each scope ring 310, 410, 510 includes the same upper component member 12 as does the scope ring 10 but include a respective lower component member 314, 414, 514. Each of the lower component members includes a removable arm 20 removably fastened to a main lower component member 316, 416, 516 that includes a non-removable arm.

The removable arm 20 is attached to the main lower component member by one or more screws 58 that each extends through a lateral slot of the mounting rail R and fastens to the other arm. The removable arm enables the lower component member to be mounted upon or removed from the mounting rail.

As shown in FIGS. 12-14, the upper component member 12 can, in all embodiments of the scope ring, be slightly separated away from the lower component member when fastened to the lower component member. The separation can better enable the upper component member 12 to conform to irregularities or tolerances in the outer diameter of the rifle scope body tube. The separation of the upper and lower component members is usually very small or non-existent and is exaggerated in FIGS. 12-14. The upper and lower component members are still considered to totally surround the body tube even if there is some slight separation to accommodate the body tube.

The scope ring 310 defines a low scope ring height. The scope ring 410 defines a medium scope ring height. The scope ring 510 defines a high scope ring height. A lower component member can also be provided that defines an extra high scope ring height and can also carry the removable arm.

A scope ring can be provided with an upper component member 12 and a removable arm 20, along with a main lower component member 316, a main lower component member 416, a main lower component member 516, and/or a main lower component member that defines an extra high scope ring height. The user can select which main lower component member to use in forming the scope ring lower component member that is attached to the mounting rail that provides a desired scope ring height.

All the illustrated scope ring embodiments illustrated in FIGS. 1-14 include the same hinged upper component member 12. A scope ring having an upper component member 12 can be provided with different r component members to not only provide different scope ring heights as previously discussed, but can be provided with different lower component members that can attach the scope ring to different types of mounting rails or with different mounting configurations (removable arm, vertically split lower component members, and the like).

Figure 15:
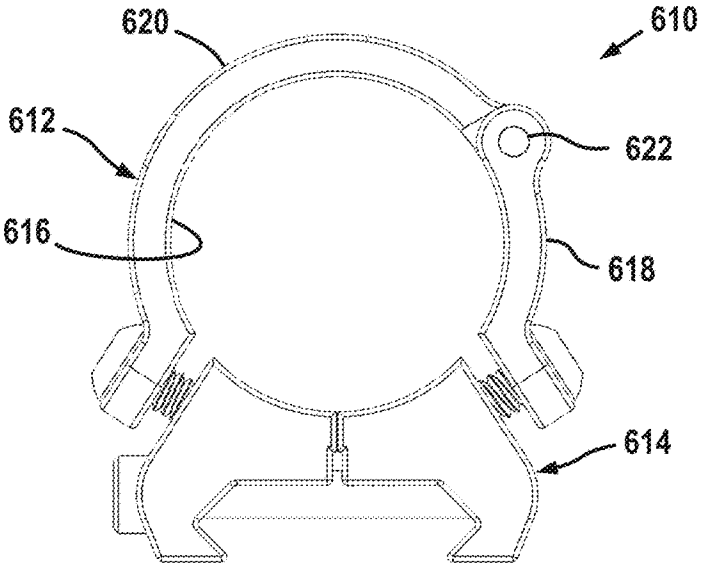
FIG. 15 is a front view of a seventh embodiment scope ring in accordance with this disclosure.

FIG. 15 illustrates a seventh embodiment scope ring embodiment 610 in accordance with this disclosure. The scope ring 610 has an upper component member 612 and a lower component member 614 that define a scope ring through-hole 616 like the scope ring through-hole 16. The lower component member 614 attaches the scope ring 610 to a mounting rail and in the illustrated embodiment is identical to the lower component member 14 of the first embodiment scope ring 10. The lower component member 314 will not be discussed in detail.

The upper component member 612 is similar to the hinged upper component member 12 in having a right upper component member 618 and a left upper component member 620 pivotally connected together by a hinge 622 similar to the hinge 34. The right and left upper component members attach to the lower component member 614 by screws extending through flanges extending from the right and left upper component members in the same way as the right and left upper component members of the upper component member 12.

The hinge 622 differs from the hinge 34 in being angularly offset with respect to the scope ring through-hole 616 whereby the left upper component member 620 has an effective angular extent of 180 degrees. In variant embodiments of the seventh embodiment scope ring the left upper component member extends more than 180 degrees and the right upper component member has a correspondingly decreased angular extent.

Because the left upper component member 620 extends at least 180 degrees, the left upper component member when unfastened from the lower component member 614 can pivot about the hinge 622 to enable a rifle scope body tube to be received into the scope ring or to be removed from the scope ring without removing the entire upper component member 612 from the lower component member 614.

A seventh embodiment scope ring can be provided with an upper component member 612 and different compatible lower component members that attach the scope ring to a mounting rail that each define respectively different scope ring heights.

Figure 16:
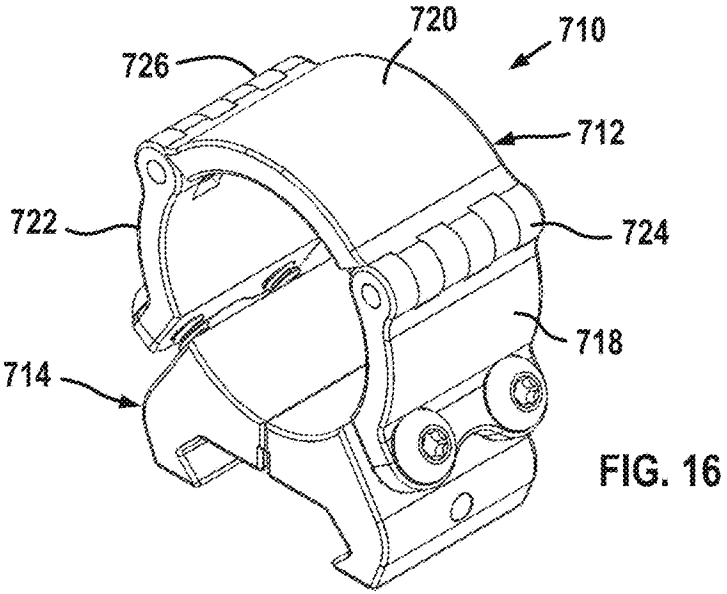
FIGS. 16 and 17 are perspective and front views respectively of an eighth embodiment scope ring in accordance with this disclosure.
Figure 17:
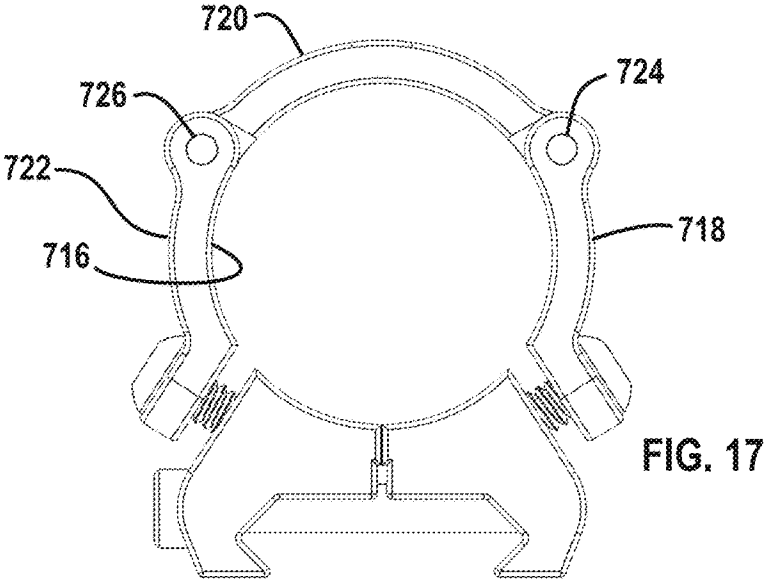

FIGS. 16 and 17 illustrate an eighth embodiment scope ring 710 in accordance with this disclosure. The scope ring 710 has an upper component member 712 and a lower component member 714 that define a scope ring through-hole 716 like the scope ring through-hole 16. The lower component member 714 attaches the scope ring 710 to a mounting rail and in the illustrated embodiment is identical to the lower component member 14. The lower component member 714 will not be discussed in more detail.

The upper component member 712 is similar to the hinged upper component member 12 but includes a right upper component member 718, a central upper component member 720, and a left upper component member 722. The right upper component member 718 is pivotally attached to the central component member 720 by a right hinge 724, similar to the hinge 34. The left upper component member 722 is pivotally attached to the central upper component member 720 by a left hinge 726, also similar to the hinge 34.

In the illustrated embodiment, each of the individual upper component members have an angular extent less than 180 degrees but each adjacent pair have an angular extent of 180 degrees. This allows either the right upper component member 718 or the left upper component member 722 to be unfastened from the lower component member 714, whereby it and the central component upper component member 620 can pivot about the hinge attached to the other of the left upper component member or the right upper component member. This enables a rifle scope body tube to be received into the scope ring or to be removed from the scope ring without removing the entire upper component member 712 from the lower component member 714.

An eighth embodiment scope ring can be provided with an upper component member 712 and different compatible lower component members that attach the scope ring to a mounting rail and that define respectively different scope ring heights.

Figure 19:
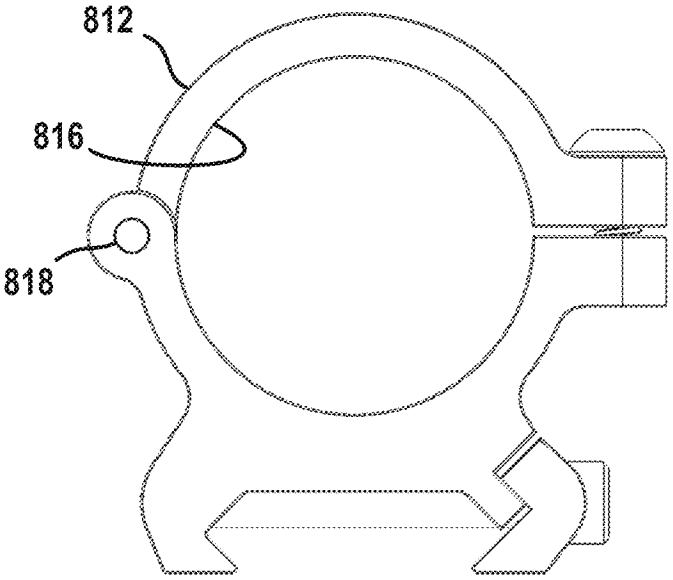
FIGS. 18 and 19 are perspective and front views respectively of a ninth embodiment scope ring in accordance with this disclosure.
Figure 18:
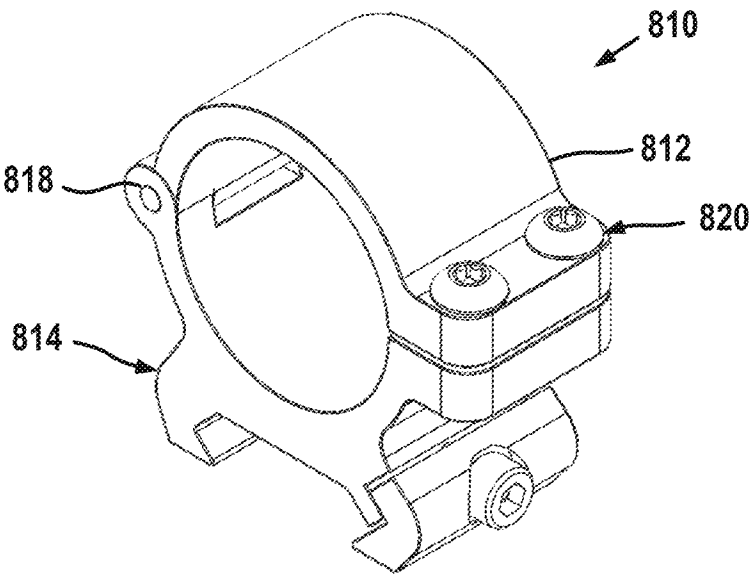

FIGS. 18 and 19 illustrate a ninth embodiment scope ring 810 in accordance with this disclosure. The scope ring 810 includes an upper component member 812 and a lower component member 814 that together define a scope ring through-hole 816 similar to the scope ring through-hole 16. The lower component member 814 attaches the scope ring 810 to a mounting rail and in the illustrated embodiment is identical to the lower component member 314. The lower component member 714 will not be discussed in more detail.

A first side of the upper component member 812 is pivotally attached to the lower component member 814 by a hinge 818 pivotally connecting the upper and lower component members together. The opposite second side of the upper component member 812 is releasably fastened to the lower component member 814 by a pair of screws 820.

Each of the upper component member 812 and the lower component member 814 has an angular extent of 180 degrees around the scope through hole 816. In other possible embodiments of the ninth embodiment scope ring 810, the upper component member 812 can have an angular extent of greater than 180 degrees about the scope ring through hole and the lower component member 814 can have a corresponding angular extent of less than 180 degrees about the scope ring through hole.

Unfastening the second side of the upper component member 812 from the lower component member 814 enables the upper component member 814 to pivot about the hinge 818 whereby a rifle scope body tube can be received into the scope ring or can removed from the scope ring.

The hinge 818 in variant embodiments of the ninth embodiment scope ring 810 can be removably fastened to the lower component member 814 by screws or other fastening means. This enables the eighth embodiment scope ring to be provided with different compatible lower component members that attach the scope ring to a mounting rail and that define respectively different scope ring heights.

Figure 21:
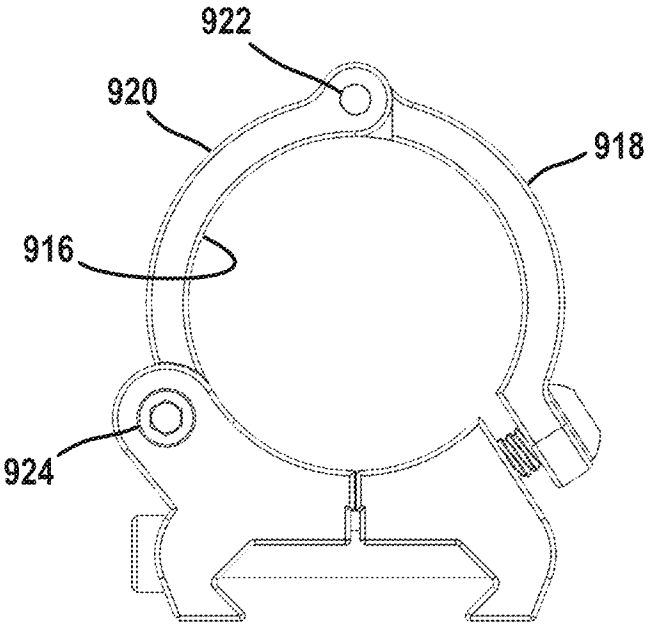
FIGS. 20 and 21 are perspective and front views respectively of a tenth embodiment scope ring in accordance with this disclosure.
Figure 20:
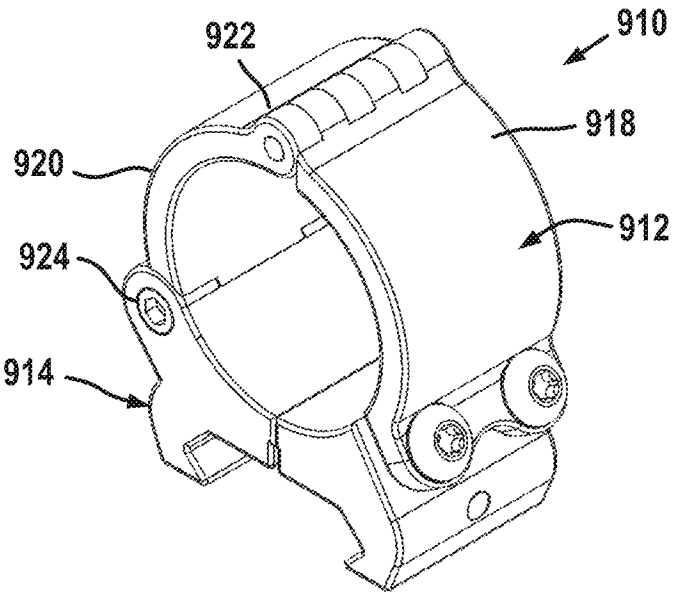
Figure 22:
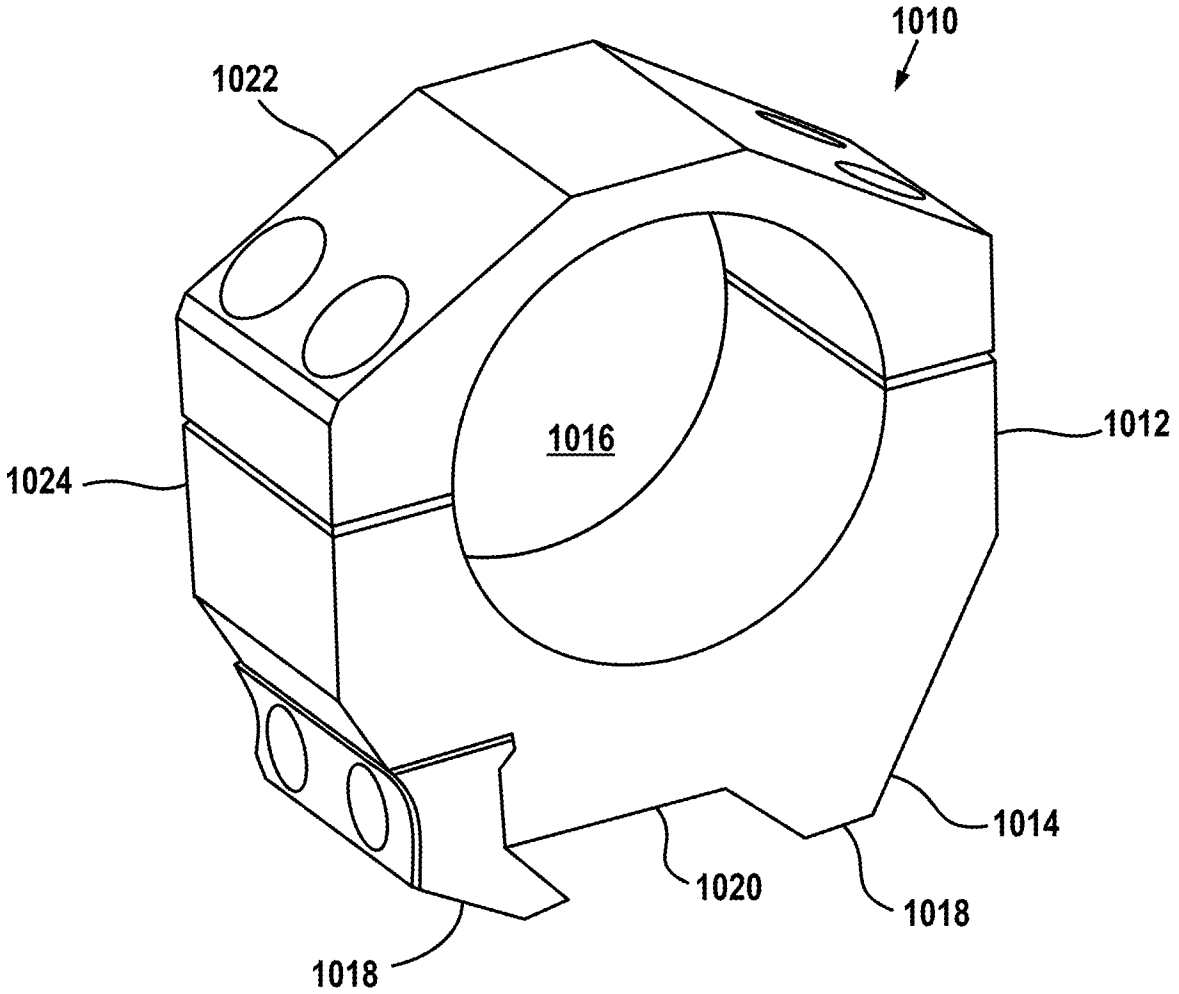
FIG. 22 PRIOR ART
FIG. 22 is an exploded, perspective view of a prior art scope ring.

FIGS. 20 and 21 illustrate a tenth embodiment scope ring 910 in accordance with this disclosure (and may be considered a variant embodiment of the ninth embodiment scope ring 810). The scope ring 910 includes an upper component member 912 and a lower component member 914 that attaches the scope ring to a mounting rail. The upper and lower component members together define a scope ring through hole 916 similar to the scope through hole 16.

The upper component member 912 is similar to the upper component member 12 in having a right upper component member 918 pivotally connected to a left upper component member 920 by a hinge 922 like the hinge 34. The end of the left upper component member 920 away from the hinge 922 is pivotally connected to the lower component member 914 by a second hinge 924. The end of the right component member 918 is fastened to the lower component member 914 by screws in the same manner the left upper component member of the scope ring 10 is attached to its lower component member.

The upper component member 912 extends about 270 degrees about the scope ring through hole 916, thus providing a compact assembly. Each of the left and right upper component members extend equally about the scope ring through hole.

Unfastening the right upper component member 918 from the lower component member 914 enables the left upper component 920 to pivot about the second hinge 924 and enables the right upper component member 918 to pivot about the hinge 922 member whereby a rifle scope body tube can be received into the scope ring or can be removed from the scope ring.

Having two pivotable members enables the upper component member 912 to extend substantially more than 180 degrees about the scope ring through hole for a compact assembly. A hinged single piece upper component member like the eighth embodiment 812 may be obstructed by the lower upper component member mounting component or the rifle from pivotal movement sufficient to receive the rifle scope body tube depending on scope ring height and other factors if the upper component member 812 extends substantially more than 180 degrees about the scope ring through hole.

The seventh embodiment scope ring 610, eighth embodiment scope ring 710, ninth embodiment scope ring 810, and tenth embodiment scope ring 910 have upper component members that are constructed and hinged to the lower component member such that the upper component member can remain attached to the lower component member when receiving a rifle scope body tube into the scope ring or removing the body tube from the scope ring.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, scope ring heights and ranges of ring heights, base configuration for mounting to other types or geometries of mounting rail (whether on long guns, crossbows, or other armaments), use of auxiliary rails to further increase scope ring height, or use of auxiliary rails that can attach the scope ring to an otherwise incompatible mounting rail, and the like.

What is claimed is:

1. A scope ring for attaching a scope to a mounting rail of an armament, the scope ring comprising:

a scope ring through-hole being configured to receive a portion of the scope;

an upper component and a lower component, the lower component having a first end portion on a first end of the lower component and an axially opposite second end portion, the first end portion being capable of being attached onto the mounting rail whereby the second end portion is spaced away from the mounting rail when the lower component is mounted on the rail;

the upper component being fastenable to the second end portion of the lower component to rigidly attach the upper component to the lower component wherein the upper component and the second end portion of the lower component cooperate to surround and define the scope ring through-hole when the upper component is fastened to the lower component;

the upper component comprising a first end and a second end, the first and second ends of the upper component being spaced apart from one another and each of the first and second ends being fixedly fastened to the lower component when the upper component is attached to the lower component;

the upper component comprising at least two members that extend end-to-end along and define a portion of an outer perimeter of the scope ring through-hole from the first end of the upper component to the second end of the upper component when the upper component is fastened to the lower component, the at least two members comprising at least one adjacent pair of members extending along the outer perimeter;

each adjacent pair of members of the at least one adjacent pair of members comprising respective adjacent ends that cooperatively define a hinge that pivotally couples the adjacent pairs of members, the hinge receiving a hinge pin that defines the pivot axis of the hinge, the hinge enabling pivotal movement of the adjacent pair of members about the hinge axis when one or both ends of the upper component is unfastened from the lower component;

the at least two members of the upper component extending more than one hundred and eighty (180) degrees in angular extent along the outer perimeter of the scope ring through-hole from the first end of the upper component to the second end of the upper component when the upper component is fastened to the lower component; and wherein the upper component and the lower component when attached together with the lower component attached onto the mounting rail define a first scope ring height, the scope ring comprising at least one additional lower component attachable to the upper component to define the scope ring through-hole, each at least one additional lower component defining a respective scope ring height in cooperation with the upper component that is different from the first scope ring height and different from the scope ring height defined by any other of the at least one additional lower component in cooperation with the upper component.

2. The scope ring of claim 1 wherein the at least two members of the upper component consists of two members.

3. The scope ring of claim 2 wherein each of the two members of the upper component extends less than one hundred and eighty (180) degrees in angular extent along the outer perimeter of the scope ring through-hole when the upper component is fastened to the lower component.

4. The scope ring of claim 3 wherein the first and second ends of the upper component are releasably fastenable to the lower component whereby the upper component is unfastenable from the lower component and can then be spaced apart from the lower component when inserting a scope into the scope ring or when removing a scope from the scope ring.

5. The scope ring of claim 2 wherein, when the upper component is fastened to the lower component, the two members of the upper component extend the same angular extent along the outer perimeter of the scope ring through-hole whereby the hinge connecting the two members is substantially centered along the outer perimeter of the scope ring through-hole between the first and second ends of the upper component.

6. The scope ring of claim 2 wherein one of the two members extends an angular extent of at least one hundred eighty (180) degrees from the first end of the upper component along the outer perimeter of the scope ring through-hole when the upper component is fastened to the lower component whereby the hinge connecting the two members is closer along the perimeter of the scope ring through-hole to the second end of the upper component than to the other end of the upper component.

7. The scope ring of claim 6 wherein at least the first end of the first and second ends of the upper component is releasably fastenable to the lower component whereby when the upper member is attached to the lower member at both the first and second ends of the upper member, the one member of the upper component disposed at the first end of the upper member can be unfastened from the lower component and is then able to pivotally displace relative to the other member fastened to the lower member to enable inserting a scope into the scope ring or when removing a scope from the scope ring.

8. The scope ring of claim 2 wherein the upper component and the lower component when attached together with the lower component being attached onto the mounting rail define a first scope ring height, the scope ring comprising at least one additional lower component being attachable to the upper component to define the scope ring through-hole, each at least one additional lower component defining a respective scope ring height in cooperation with the upper component different from the first scope ring height and also different from the scope ring height defined by any other of the at least one additional lower component in cooperation with the upper component.

9. The scope ring of claim 1 wherein the at least two members of the upper component consists of three members, one pair of adjacent members being disposed at the first end of the upper component extending together an angular extent of at least one hundred eighty (180) degrees along the outer perimeter of the scope ring through-hole when the upper component is attached to the lower component.

10. The scope ring of claim 9 wherein at least the first end of the first and second ends of the upper component is releasably fastenable to the lower component whereby when the upper component is attached to the lower component at both the first and second ends of the upper component, the member at the first end of the upper component can be unfastened from the lower component and the pair of adjacent members disposed at the first end of the upper component can be displaced relative to the lower component to enable inserting a scope into the scope ring or removing a scope from the scope ring.

11. The scope ring of claim 9 wherein the upper component and the lower component when attached together with the lower component attached onto the mounting rail define a first scope ring height, the scope ring comprising at least one additional lower component attachable to the upper component to define the scope ring through-hole, each at least one additional lower component defining a respective scope ring height in cooperation with the upper component that is different from the first scope ring height and different from the scope ring height defined by any other of the at least one additional lower component in cooperation with the upper component.

12. A scope ring for attaching a scope to a mounting rail of an armament, the scope ring comprising:

a scope ring through-hole being configured to receive a portion of the scope;

an upper component and a lower component, the lower component having a first end portion on a first end of the lower component and an axially opposite second end portion, the first end portion being capable of being attached onto the mounting rail whereby the second end portion is spaced away from the mounting rail when the lower component is mounted on the rail;

the upper component being fastenable to the second end portion of the lower component to rigidly attach the upper component to the lower component wherein the upper component and the second end portion of the lower component cooperate to surround and define the scope ring through-hole when the upper component is fastened to the lower component;

the upper component comprising a first end and a second end, the first and second ends of the upper component being spaced apart from one another and each of the first and second ends being fixedly fastened to the lower component when the upper component is attached to the lower component;

the upper component comprising at least two members that extend end-to-end along and define a portion of an outer perimeter of the scope ring through-hole from the first end of the upper component to the second end of the upper component when the upper component is fastened to the lower component, the at least two members comprising at least one adjacent pair of members extending along the outer perimeter, each at least one adjacent pair of members being pivotally connected to one another by a hinge that defines a hinge axis, the hinge enabling pivotal movement about the hinge axis when one or both ends of the upper component is unfastened from the lower member;

the at least two members of the upper component extending more than one hundred and eighty (180) degrees in angular extent along the outer perimeter of the scope ring through-hole from the first end of the upper component to the second end of the upper component when the upper component is fastened to the lower component; and the upper component and the lower component when attached together with the lower component attached onto the mounting rail defining a first scope ring height, the scope ring comprising at least one additional lower component attachable to the upper component to define the scope ring through-hole, each at least one additional lower component defining a respective scope ring height in cooperation with the upper component that is different from the first scope ring height and different from the scope ring height defined by any other of the at least one additional lower component in cooperation with the upper component.

13. A scope ring for attaching a scope to a mounting rail of an armament, the scope ring comprising:

a scope ring through-hole being configured to receive a portion of the scope;

an upper component and a lower component, the lower component having a first end portion on a first end of the lower component and an axially opposite second end portion, the first end portion being capable of being attached onto the mounting rail whereby the second end portion is spaced away from the mounting rail when the lower component is mounted on the rail;

the upper component being fastenable to the second end portion of the lower component to rigidly attach the upper component to the lower component wherein the upper component and the second end portion of the lower component cooperate to surround and define the scope ring through-hole when the upper component is fastened to the lower component;

the upper component comprising a first end and a second end, the first and second ends of the upper component being spaced apart from one another and each of the first and second ends being fixedly fastened to the lower component when the upper component is attached to the lower component;

the upper component consisting of two members that extend end-to-end along and define a portion of an outer perimeter of the scope ring through-hole from the first end of the upper component to the second end of the upper component when the upper component is fastened to the lower component, the two members being pivotally connected to one another by a hinge that defines a hinge axis, the hinge enabling pivotal movement of the two members about the hinge axis when one or both ends of the upper component is unfastened from the lower member;

the two members of the upper component extending more than one hundred and eighty (180) degrees in angular extent along the outer perimeter of the scope ring through-hole from the first end of the upper component to the second end of the upper component when the upper component is fastened to the lower component; and the upper component and the lower component when attached together with the lower component attached onto the mounting rail defining a first scope ring height, the scope ring comprising at least one additional lower component attachable to the upper component to define the scope ring through-hole, each at least one additional lower component defining a respective scope ring height in cooperation with the upper component different from the first scope ring height and also different from the scope ring height defined by any other of the at least one additional lower component in cooperation with the upper component.

* * * * *